US007281451B2

(12) United States Patent
Schulze Beckinghausen

(10) Patent No.: US 7,281,451 B2
(45) Date of Patent: Oct. 16, 2007

(54) TONG

(75) Inventor: Joerg E. Schulze Beckinghausen, Garbsen (DE)

(73) Assignee: Weatherford/Lamb, Inc., Houston, TX (US)

( * ) Notice: Subject to any disclaimer, the term of this patent is extended or adjusted under 35 U.S.C. 154(b) by 37 days.

(21) Appl. No.: 10/794,792

(22) Filed: Mar. 5, 2004

(65) Prior Publication Data

US 2004/0237726 A1 Dec. 2, 2004

Related U.S. Application Data

(63) Continuation-in-part of application No. 10/048,353, filed on Jun. 11, 2002, now Pat. No. 6,745,646, which is a continuation-in-part of application No. 10/146,599, filed on May 15, 2002, now Pat. No. 6,814,149, which is a continuation-in-part of application No. 10/074,947, filed on Feb. 12, 2002, now Pat. No. 7,028,585.

(60) Provisional application No. 60/452,270, filed on Mar. 5, 2003.

(51) Int. Cl.
*B25B 13/50* (2006.01)

(52) U.S. Cl. ..... 81/57.34; 81/57.16

(58) Field of Classification Search ..... 81/57.33, 81/57.34, 57.15, 57.16, 57.18–57.21, 57.35, 81/57.24, 57.25

See application file for complete search history.

(56) References Cited

U.S. PATENT DOCUMENTS 1,150,178 A 8/1915 Deifendorf
1,386,908 A 8/1921 Taylor
1,842,638 A 1/1932 Wigle
2,214,194 A 9/1940 Frankley
2,214,429 A 9/1940 Miller (Continued)

FOREIGN PATENT DOCUMENTS

DE 2 128 362 1/1972

(Continued)

OTHER PUBLICATIONS

PCT Search Report, International Application No. PCT/US2004/006753, dated Sep. 8, 2004.

(Continued)

*Primary Examiner*—D. S. Meislin
(74) *Attorney, Agent, or Firm*—Patterson & Sheridan, LLP

(57) ABSTRACT

Methods and apparatus for making and breaking tubular connections within a tubular string are disclosed. In certain aspects, a tong assembly includes gated power and back up tongs coupled to a torque bar. Jaws of the tongs may be arranged circumferentially with support members disposed between adjacent jaws to substantially complete a 360° closed circle. A hydraulic circuit may equally distribute fluid and pressure to actuate the jaws. The power tong may include a gated rotor driven by at least three drive motors. The rotor may be selectively physically locked from rotation or movement by one or more rotor locks. Further, the tong assembly may include an interlock that prevents activation of the drive motors until the rotor locks actuate to unlock the rotor. Additionally, gate locks may secure the tongs and rotor when closed, and a releasable coupling arrangement may aid engagement of a motor to a rotor pump.

24 Claims, 9 Drawing Sheets

U.S. PATENT DOCUMENTS 2,522,444 A 9/1950 Grable
2,566,561 A 9/1951 Edelberg
2,610,690 A 9/1952 Beatty
2,639,894 A 9/1953 Smith
2,950,639 A 8/1960 Mason
3,021,739 A 2/1962 Grundmann
3,041,901 A 7/1962 Knights
3,086,413 A 4/1963 Mason
3,122,811 A 3/1964 Gilreath
3,131,586 A 5/1964 Wilson
3,180,186 A 4/1965 Catland
3,220,245 A 11/1965 Van Winkle
3,302,496 A 2/1967 Mitchell et al.
3,349,455 A 10/1967 Doherty
3,443,291 A 5/1969 Doherty
3,475,038 A 10/1969 Matherne
3,518,903 A 7/1970 Ham et al.
3,559,739 A 2/1971 Hutchison
3,606,664 A 9/1971 Weiner
3,680,412 A 8/1972 Mayer et al.
3,722,331 A 3/1973 Radulescu
3,747,675 A 7/1973 Brown
3,796,418 A 3/1974 Carlberg
3,808,916 A 5/1974 Porter et al.
3,838,613 A 10/1974 Wilms
3,902,385 A 9/1975 Haby
3,933,108 A 1/1976 Baugh
3,941,348 A 3/1976 Mott
3,986,564 A 10/1976 Bender
4,005,621 A 2/1977 Turner, Jr. et al.
4,023,449 A 5/1977 Boyadjieff
4,142,739 A 3/1979 Billingsley
4,147,215 A 4/1979 Hodge et al.
4,159,637 A 7/1979 Lamb et al.
4,170,908 A 10/1979 Peveto et al.
4,202,225 A 5/1980 Sheldon et al.
4,215,602 A 8/1980 Carstensen et al.
4,221,269 A 9/1980 Hudson
4,246,809 A 1/1981 Keast et al.
4,257,442 A 3/1981 Claycomb
4,262,693 A 4/1981 Giebeler
4,280,380 A 7/1981 Eshgy
4,291,762 A 9/1981 Gudgel
4,295,527 A 10/1981 Russe
4,315,553 A 2/1982 Stallings
4,334,444 A 6/1982 Carstensen et al.
4,346,629 A 8/1982 Kinzbach
4,401,000 A 8/1983 Kinzbach
4,402,239 A 9/1983 Mooney
4,403,666 A 9/1983 Willis
4,442,892 A 4/1984 Delesandri
RE31,699 E 10/1984 Eckel
4,492,134 A 1/1985 Reinholdt et al.
4,497,224 A 2/1985 Jurgens
4,499,919 A 2/1985 Forester
4,565,003 A 1/1986 McLeod
4,572,036 A 2/1986 Renfro
4,573,359 A 3/1986 Carstensen
4,592,125 A 6/1986 Skene
4,593,773 A 6/1986 Skeie
4,643,259 A 2/1987 Zeringue, Jr.
4,648,292 A 3/1987 Haynes et al.
4,649,777 A 3/1987 Buck
4,709,766 A 12/1987 Boyadjieff
4,712,284 A 12/1987 Coyle, Sr. et al.
4,715,625 A 12/1987 Shows, Jr. et al.
4,732,373 A 3/1988 Yang
4,738,145 A 4/1988 Vincent et al.
4,773,218 A 9/1988 Wakita et al.
4,811,635 A 3/1989 Falgout, Sr.
4,821,814 A 4/1989 Willis et al.
4,869,137 A 9/1989 Slator
4,895,056 A 1/1990 Schulze-Beckinghausen
4,938,109 A 7/1990 Torres et al.
4,969,638 A 11/1990 Yang
4,979,356 A 12/1990 Vatne
5,000,065 A 3/1991 Haynes
5,022,472 A 6/1991 Bailey et al.
5,044,232 A 9/1991 Schulze-Beckinghausen
5,054,550 A 10/1991 Hodge
5,081,888 A 1/1992 Schulze-Beckinghausen
5,092,399 A 3/1992 Lang
RE34,063 E 9/1992 Vincent et al.
5,150,642 A 9/1992 Moody et al.
5,159,860 A 11/1992 Pietras
5,161,438 A 11/1992 Pietras
5,167,173 A 12/1992 Pietras
5,172,613 A * 12/1992 Wesch, Jr. ..... 81/57.33
5,209,302 A 5/1993 Robichauex et al.
5,221,099 A 6/1993 Jansch
5,259,275 A 11/1993 Schulze-Beckinghausen
5,297,833 A 3/1994 Willis et al.
5,390,568 A 2/1995 Pietras
5,451,084 A 9/1995 Jansch
5,520,072 A 5/1996 Perry
5,634,671 A 6/1997 Watkins
5,667,026 A 9/1997 Lorenz et al.
5,706,893 A 1/1998 Morgan
5,730,471 A 3/1998 Schulze-Beckinghausen et al.
5,746,276 A 5/1998 Stuart
5,787,982 A 8/1998 Bakke
5,819,605 A 10/1998 Buck et al.
5,839,330 A 11/1998 Stokka
5,842,390 A 12/1998 Bouligny et al.
5,845,549 A 12/1998 Bouligny
5,992,801 A 11/1999 Torres
5,996,444 A 12/1999 Pearce et al.
6,047,775 A 4/2000 Mock
6,056,060 A * 5/2000 Abrahamsen et al. ..... 166/380
6,065,372 A 5/2000 Rauch
6,082,224 A 7/2000 McDaniels et al.
6,082,225 A 7/2000 Richardson
6,116,118 A 9/2000 Wesch, Jr.
6,119,772 A 9/2000 Pruet
6,138,529 A 10/2000 Pietras
6,142,041 A 11/2000 Buck
6,161,617 A 12/2000 Gjedebo
6,206,096 B1 3/2001 Belik
6,223,629 B1 5/2001 Bangert
6,253,845 B1 7/2001 Belik
6,276,238 B1 8/2001 Junck et al.
6,305,720 B1 10/2001 Spiering et al.
6,315,051 B1 11/2001 Ayling
6,327,938 B1 12/2001 Pietras
6,330,911 B1 12/2001 Allen et al.
6,360,633 B2 3/2002 Pietras
6,374,706 B1 4/2002 Newman
6,412,554 B1 7/2002 Allen et al.
6,480,811 B2 11/2002 Denny et al.
6,598,501 B1 7/2003 Schulze-Beckinghausen et al.
6,668,684 B2 12/2003 Allen et al.
6,684,737 B1 2/2004 Schulze-Beckinghausen et al.
2002/0157823 A1 10/2002 Pietras et al.
2003/0075023 A1 4/2003 Robichaux
2004/0035573 A1 2/2004 Pietras
2004/0049905 A1 3/2004 Jansch et al.

FOREIGN PATENT DOCUMENTS

DE 3 523 221 2/1987
EP 0 087 373 8/1983
EP 0 285 386 10/1988
EP 0 311 455 4/1989
EP 0 339 005 10/1989

| | | | |
|---|---|---|---|
| EP | 0 423 055 | A2 | 4/1991 |
| EP | 0 525 247 | A1 | 2/1993 |
| GB | 804798 | | 11/1958 |
| GB | 981 569 | | 1/1965 |
| GB | 1 215 967 | | 12/1970 |
| GB | 1 301 560 | | 12/1972 |
| GB | 2 049 518 | A | 12/1980 |
| GB | 2 128 526 | | 8/1983 |
| GB | 2 115 940 | | 9/1983 |
| GB | 2 300 896 | | 11/1996 |
| GB | 2 346 577 | | 1/1999 |
| GB | 2 344 781 | | 6/2000 |
| GB | 2 356 576 | A | 8/2000 |
| GB | 2 352 667 | | 2/2001 |
| WO | WO83/03443 | | 10/1983 |
| WO | WO92/18744 | | 10/1992 |
| WO | WO93/18276 | | 9/1993 |
| WO | WO95/20471 | | 8/1995 |
| WO | WO98/16716 | | 4/1998 |
| WO | WO98/32948 | | 7/1998 |
| WO | WO99/34089 | | 7/1999 |
| WO | WO99/34090 | | 7/1999 |
| WO | WO99/34091 | | 7/1999 |
| WO | WO 00/22278 | | 4/2000 |
| WO | WO 00/23686 | | 4/2000 |
| WO | WO 00/45026 | | 8/2000 |
| WO | WO 00/45027 | | 8/2000 |
| WO | WO 00/61906 | | 10/2000 |
| WO | WO 00/74899 | | 12/2000 |
| WO | WO 00/79092 | | 12/2000 |
| WO | WO 01/03889 | | 1/2001 |
| WO | WO 01/09479 | | 2/2001 |
| WO | WO 01/38688 | | 5/2001 |
| WO | WO 01/66905 | A2 | 9/2001 |
| WO | WO 01/81047 | | 11/2001 |
| WO | WO 02/04173 | | 1/2002 |

OTHER PUBLICATIONS

PCT International Search Report dated Jun. 28, 2000, for International Application Serial No. PCT/GB00/01246.

International Search Report, International Application No. PCT/GB 01/00781, dated Sep. 27, 2001.

PCT International Search Report, International Application No. PCT/US 03/03195, dated Oct. 22, 2003.

PCT International Preliminary Examination Report from International application PCT/GB00/04383, Dated Feb. 26, 2002.

U.S. Appl. No. 10/681,570; Pietras, et al; filed Oct. 8, 2003; Tong Assembly.

GB Examination Report, Application.: GB 0520001.9, dated Jul. 5, 2006.

* cited by examiner

TONG

CROSS-REFERENCE TO RELATED APPLICATIONS

This application claims benefit of U.S. provisional patent application Ser. No. 60/452,270, filed Mar. 5, 2003. This application is a continuation-in-part of U.S. patent application Ser. No. 10/048,353, filed Jun. 11, 2002, now U.S. Pat. No. 6,745,646, which is herein incorporated by reference. This application is a continuation-in-part of U.S. patent application Ser. No. 10/146,599, filed May 15, 2002, now U.S. Pat. No. 6,814,149, which is a continuation-in-part of U.S. patent application Ser. No. 10/074,947, filed Feb. 12, 2002, now U.S. Pat. No. 7,028,585, all of which are herein incorporated by reference.

BACKGROUND OF THE INVENTION

1. Field of the Invention

The invention generally relates to methods and apparatus for use in making or breaking tubular connections. More particularly, the invention relates to a tong assembly for use in making or breaking tubular connections within a tubular string of an oil or gas well.

2. Description of the Related Art

Construction of oil or gas wells usually requires making long tubular strings that make up casing, risers, drill pipe or other tubing. Due to the length of these strings, sections or stands of tubulars are progressively added to the tubular string as it is lowered from a drilling platform. In particular, applying slips of a spider located in the floor of the drilling platform usually restrains the tubular string from falling when it is desired to add a section or stand of tubular. The new section or stand of tubular is then moved from a rack to above the spider. The threaded pin of the section or stand of tubular to be connected is then located over the threaded box of the tubular string and a connection is made up by rotation therebetween. Thereafter, the spider releases the newly extended tubular string, and the whole tubular string lowers until the top of the tubular string is adjacent the spider whereupon the slips of the spider reapply to maintain the position of the tubular string for repeating the process.

It is common practice to use a tong assembly to apply a predetermined torque to the connection in order to make this connection. The tong assembly is typically located on the platform, either on rails, or hung from a derrick on a chain. In order to make up or break out a threaded connection, the tong assembly includes a two tong arrangement. An active (or power) tong supplies torque to the section of tubular above the threaded connection, while a passive (or back up) tong supplies a reaction torque to a lower tubular below the threaded connection. Particularly, the back up tong clamps the lower tubular below the threaded connection and prevents it from rotating. The clamping of the tubulars may be performed mechanically, hydraulically, or pneumatically. The power tong clamps the upper part of the connection and is driven so that it supplies torque for at least a limited angle.

In order to make up or break out a connection between tubulars in a tubular string, torque must be supplied over a large angle without having to take time to release and clamp the tubular again. Large diameter and heavy tubulars such as risers have threaded connections requiring a high torque that prior tong assemblies fail to provide. For example, the prior tong assemblies having one or two drives fail to provide a sufficient rotation force to a rotary of the power tong. Further, a jaw assembly of the prior tong assemblies tends to tilt and provide a non-uniform load on the tubular surfaces when used at the high torques. When the jaw assembly tilts, only a portion of the jaw assembly contacts the tubular, thereby causing damage to the tubular, limiting the torque that can be applied and causing failure of the jaw assembly itself.

In use, the reaction force on the power tong transmits through the connection and the back up tong to the lower tubular. This torsional force creates a side force tending to move the back up tong and power tong out of axial alignment, thereby bending the tubular string at the connection. Thus, torque transmitting devices used with power tongs and back up tongs inhibit them from moving out of axial alignment. However, prior torque transmitting devices limit how close that the power tong and back up tong may be spaced.

The possibility of a premature rotation of the rotary gear such as prior to closing gates of the tong assembly presents a serious potential danger to an operator. While the gates are open, the rotary gear may become misaligned with the power tong. Further, premature rotation can cause costly and time consuming damage to the tong assembly.

Therefore, there exists a need for an improved method and apparatus for making or breaking a tubular connection. There exists a further need for a tong assembly that includes an improved jaw assembly, rotor, torque transmitting device, and/or safety features.

SUMMARY OF THE INVENTION

The invention generally relates to methods and apparatus for making and breaking tubular connections within a tubular string. In certain aspects, a tong assembly includes gated power and back up tongs coupled to a torque bar. Jaws of the tongs may be arranged circumferentially with support members disposed between adjacent jaws to substantially complete a 360° closed circle. A hydraulic circuit may equally distribute fluid and pressure to actuate the jaws. The power tong may include a gated rotor driven by at least three drive motors. The rotor may be selectively physically locked from rotation or movement by one or more rotor locks. Further, the tong assembly may include an interlock that prevents activation of the drive motors until the rotor locks actuate to unlock the rotor. Additionally, gate locks may secure the tongs and rotor when closed, and a releasable coupling arrangement may aid engagement of a motor to a rotor pump.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally relates to a tong assembly for making up and breaking out a tubular connection such as between two tubulars in a tubular string. The tubular string may be made of tubulars that form a riser, casing, drill pipe or other tubing. In operation, the tong assembly grips the tubulars and applies torque to the connection. For example, the tong assembly may apply 300,000 foot pounds of torque to a riser thread connection in a riser string that is about twenty inches in diameter.

Figure 1:
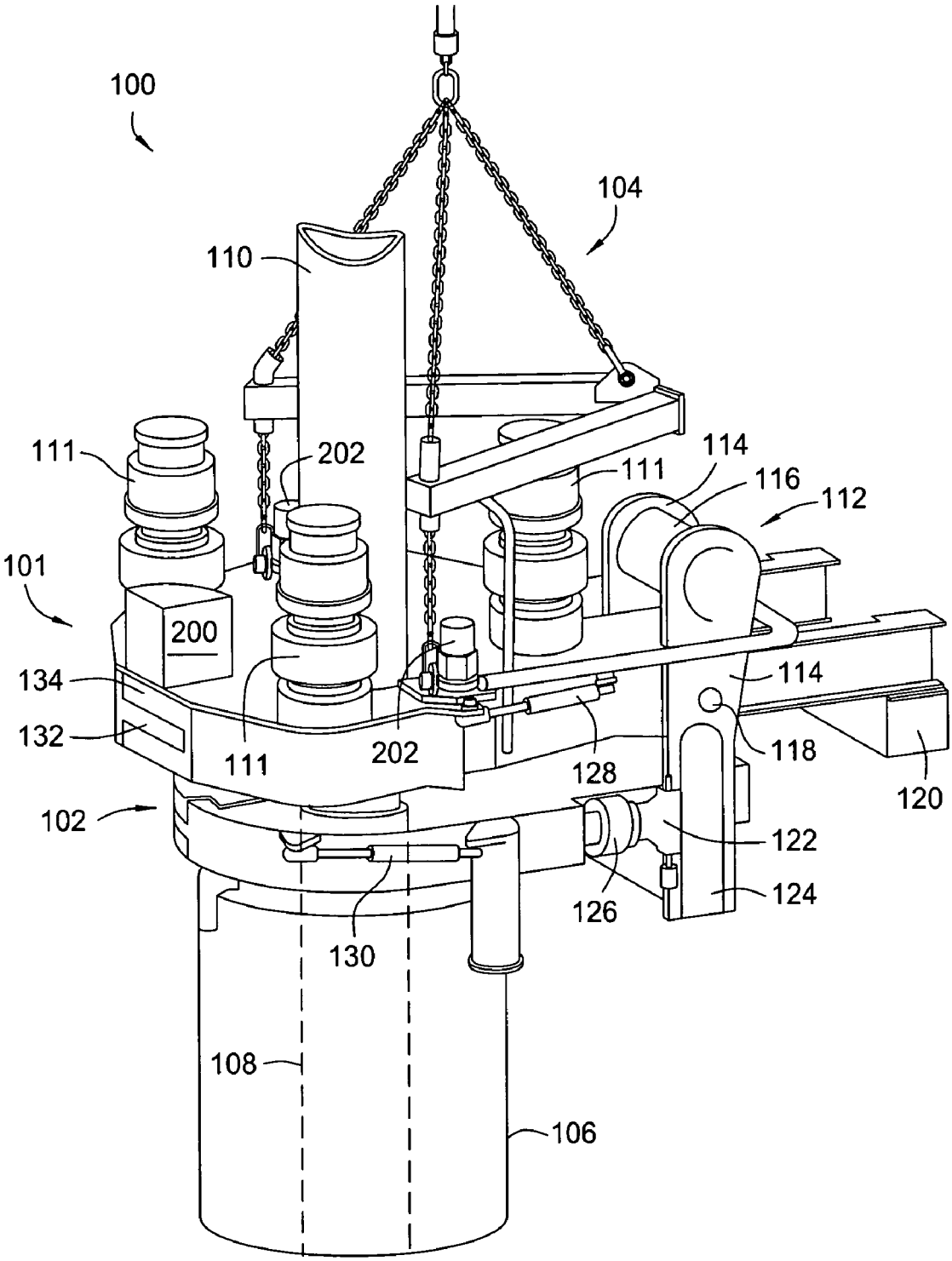
FIG. 1 is a view of an embodiment of a tong assembly in operation with a tubular string positioned therein.

FIG. 1 illustrates an embodiment of a tong assembly 100 according to aspects of the invention. The tong assembly 100 includes a power tong 101 disposed above a back up tong 102. In operation, the tong assembly 100 suspends from a handling tool 104 that positions the tong assembly 100 around a tubular of a tubular string such as a lower tubular 108 held by a spider 106 and a stand or upper tubular 110. As described in more detail below, the power tong 101 grips the upper tubular 110, the back up tong 102 grips the lower tubular 108, and the power tong 101 rotates the upper tubular 110 in order to make up or break out a connection between the tubulars 108, 110. Three drive motors 111 operate to rotate the upper tubular 110.

Each of the tongs 101, 102 are segmented into three segments such that the front two segments pivotally attach to the back segment and enable movement of the tongs 101, 102 between an open and a closed position. In the open position, the front sections pivot outward enabling the tubulars 108, 110 to pass between the front sections so that the handling tool 104 can align the tubulars 108, 110 within the tongs 101, 102. The tongs 101, 102 move to the closed position as shown in FIG. 1 prior to make up or break out operations. Pistons 128 (only one piston is visible) on each side of the power tong 101 operate to pivot the front segments relative to the back segment in order to open and close a gate between the front segments that is formed where an extension 132 on one of the front segments mates with a corresponding grooved portion 134 of the other front section. Similarly, pistons 130 (again only one piston is visible) on each side of the back up tong 102 operate to pivot the front segments relative to the back segment in order move the back up tong between the open and closed position. The pistons 128, 130 may be operated by a tong assembly hydraulic circuit that supplies fluid pressure to various components of the tong assembly 100 through a common pressure source. As with all other components of the tong assembly 100 operated by the tong assembly hydraulic circuit, automated or manually operated valves (not shown) may be used to separately or in combination open and close fluid supply to each component (e.g. the pistons 128, 130) at the desired time.

A torque bar assembly 112 located adjacent a counterweight 120 connects the power tong 101 to the back up tong 102. The torque bar assembly 112 includes two arms 114 extending downward from each end of a horizontal top bar or suspension 116. A back end of the power tong 101 connects to a horizontal shaft 118 that extends between the arms 114 below the suspension 116. The shaft 118 may fit within bearings (not shown) in the arms 114 to permit pivoting of the power tong 101 relative to the torque bar assembly 112. Damping cylinders 400 (shown in FIG. 4) connect between a top of the power tong 101 and the suspension 116 to prevent free swinging of the power tong 101 about the shaft 118. Clamps 122 on the back up tong 102 grip a longitudinal recess 124 in the arms 114, thereby securing the back up tong 102 to the torque bar assembly 112. The clamps 122 slide along the recess 124 to permit movement of the back up tong 102 relative to the power tong 101 during make up or break out operations. The torque bar assembly 112 provides a connection between the tongs 101, 102 that permits the back up tong 102 to rise into near contact with the power tong 101.

The torque bar assembly 112 keeps side forces out of the connection between the tubulars 108, 110 by eliminating or at least substantially eliminating shear and bending forces. As the power tong 101 applies torque to the upper tubular 110, reaction forces transfer to the torque bar assembly 112 in the form of a pair of opposing forces transmitted to each arm 114. The forces on the arms 114 place the suspension 116 in torsion while keeping side forces out of the connection. A load cell and compression link 126 may be positioned between the clamp 122 and back up tong 102 in order to measure the torque between the power tong 101 and back up tong 102 during make up and break out operations.

Figure 2:
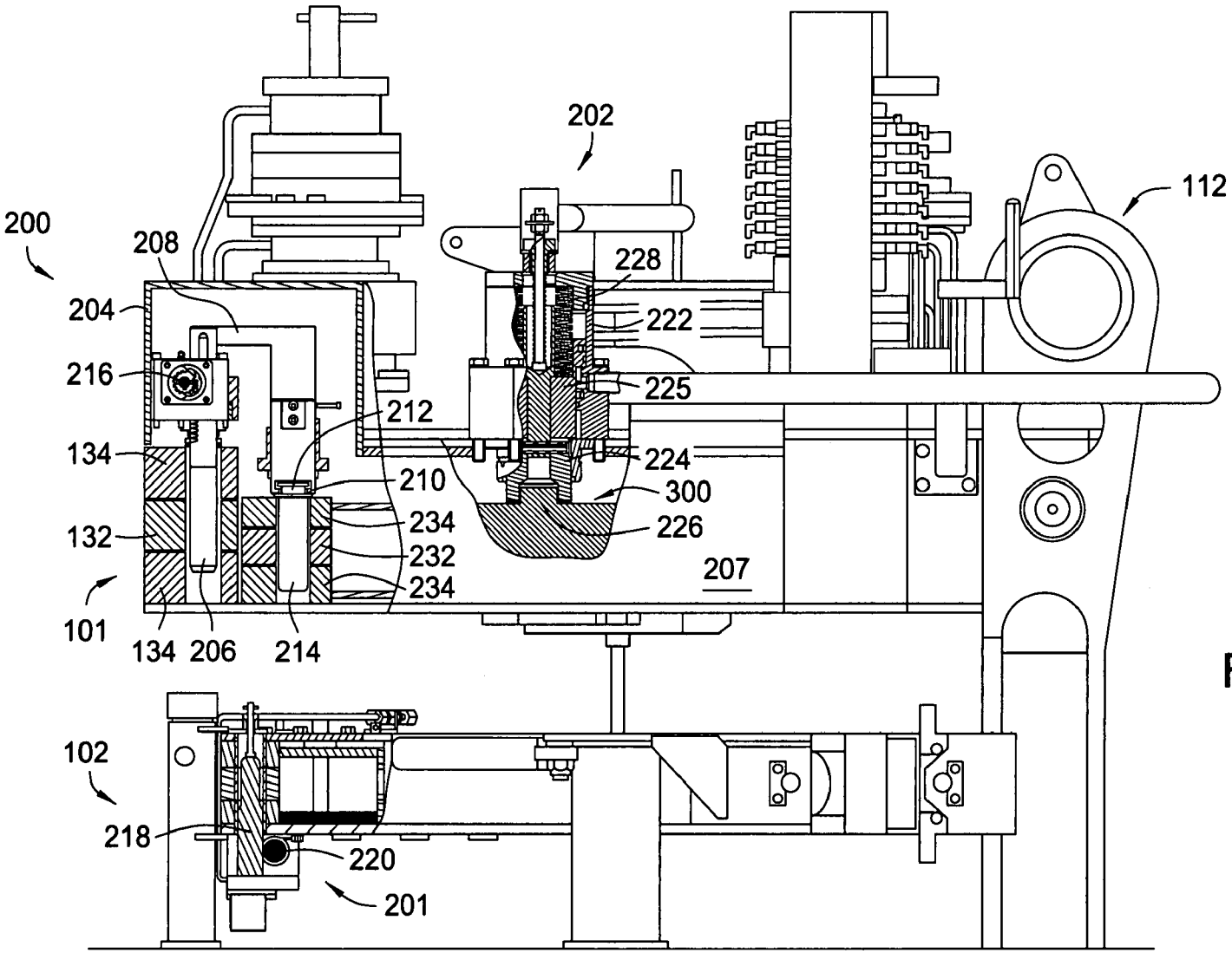
FIG. 2 is a side view of the tong assembly showing a detail of gate locks on a power tong and a back up tong and a detail of a rotor lock on the power tong.

FIG. 2 shows a side of the tong assembly 100 and a detail of a power tong gate lock 200, a back up gate lock 201 and a rotor lock 202. The gate locks 200, 201 lock the tongs 101, 102 in the closed position. The rotor lock 202 prevents rotation of a rotor 300 when in the open position and prevents any possible misalignment of parts of the rotor 300 caused by moving the power tong 101 to the open position since the rotor may be forced outward in the open position. Thus, the rotor lock 202 maintains the rotor 300 in position and prevents rotation of the rotor 300 until the rotor lock 202 is actuated.

The power tong gate lock 200 includes an outer shroud 204 mounted on a housing 207 of the power tong 101. The outer shroud 204 supports a gear profiled bolt 206 having a lifting member 208 connected thereto. Rotation of a gear 216 mated with the gear profiled bolt 206 lowers and raises the gear profiled bolt 206 between a power tong gate locked position and a power tong gate unlocked position. In the power tong gate locked position shown in FIG. 2, the gear profiled bolt 206 inserts downward into an aperture within the extension 132 and an aperture in the corresponding grooved portion 134 that form the gate in the housing 207 of the power tong 101. Thus, the gear profiled bolt 206 maintains the power tong 101 in the closed position by preventing movement between the extension 132 and the corresponding grooved portion 134 when in the power tong gate locked position. The gear may be actuated by a hydraulic or electric motor (not shown) controlled by the tong assembly hydraulic circuit.

At the end of the lifting member 208, a slotted lip 210 receives a recessed profile 212 at the top of a rotor bolt 214.

Figure 3:
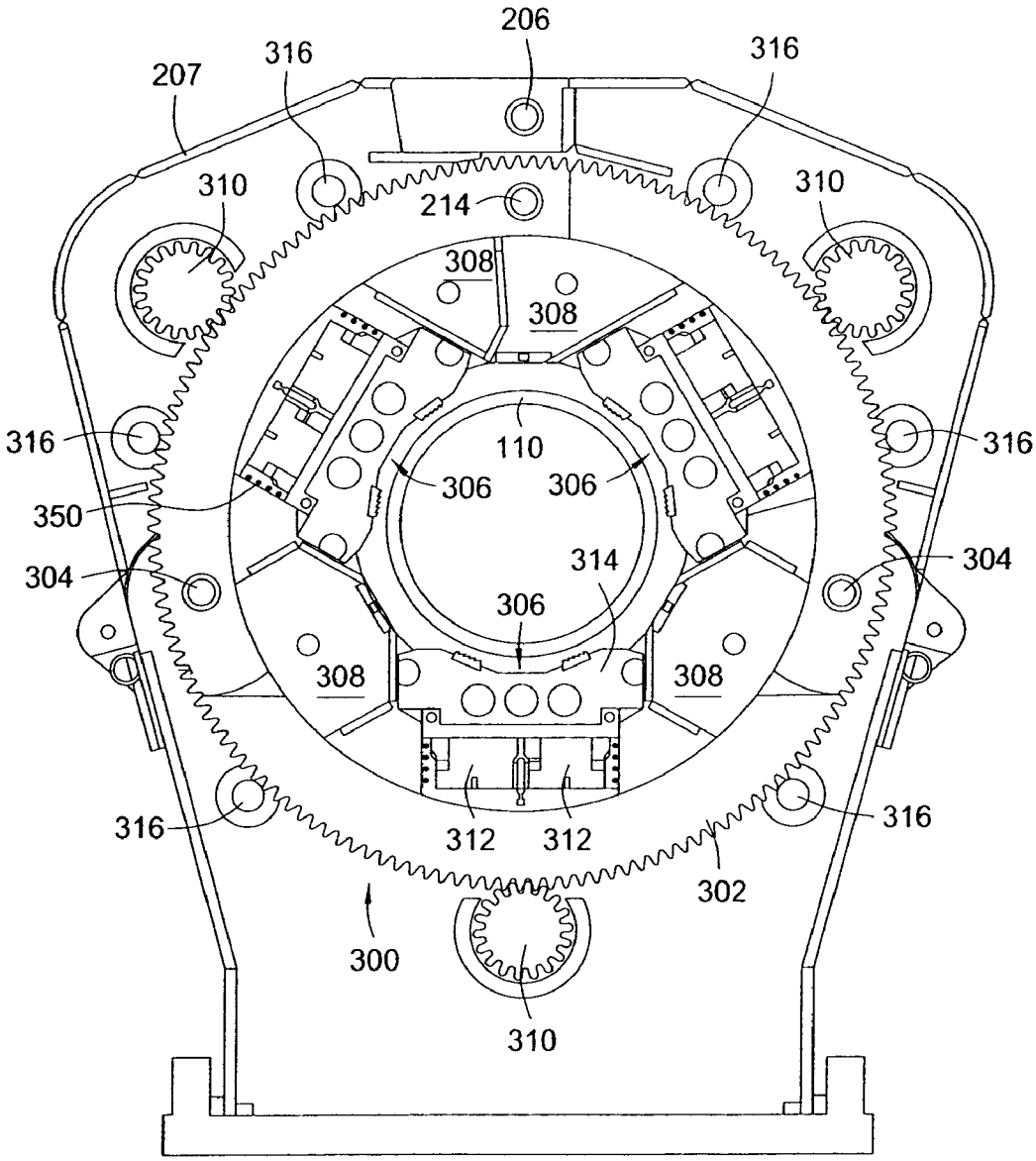
FIG. 3 is a section view of the power tong illustrating a rotor with jaws according to aspects of the invention.

Due to the slotted lip 210 fitting in the recessed profile 212, the lifting member 208 which raises and lowers with the gear profiled bolt 206 acts to raise and lower the rotor bolt 214 when the rotor bolt 214 is aligned below the lifting member 208. Similar to the housing of the power tong 101, a rotor 300 is gated so that the rotor 300 opens and closes as the power tong 101 moves between the open and closed positions. Thus, the rotor 300 includes a rotor extension 232 and a corresponding rotor grooved portion 234 that each have an aperture therein for receiving the rotor bolt 214 which prevents movement between the rotor extension 232 and the corresponding rotor grooved portion 234 while in the power tong gate locked position. As the rotor 300 rotates during make up and break out operations, the recessed profile 212 of the rotor bolt 214 slides out of engagement with the slotted lip 210 and may pass through the slotted lip 210 with each revolution of the rotor 300. The rotor bolt 214 realigns with the lifting member 208 when the rotor returns to a start position such that the rotor bolt 214 may be raised to the power tong gate unlocked position. Only when the rotor 300 is in the start position with segments of the rotor 300 properly aligned may the power tong 101 be moved to the open position. FIG. 3 further illustrates the power tong 101 in the start position with the rotor bolt 214 and the gear profiled bolt 206 maintaining the power tong 101 in the closed position.

The back up gate lock 201 locks the gate on the back up tong 102 in the closed position similar to the power tong gate lock 200 for the power tong 101. A single back up bolt 218 operated by a gear 220 moves between a back up gate locked position and a back up gate unlocked position. Since the back up tong 102 does not have a front housing or a rotor that rotates, a back up jaw assembly may include a gated section therein with mating features such as the gate of the power tong 101. Thus, the bolt 218 in the back up gate locked position prevents movement between members in the gated section of the back up jaw assembly similar to the gear profiled bolt 206 and rotor bolt 214 used in the power tong gate lock 200 on the power tong 101.

Referring still to FIG. 2, the rotor lock 202 mounts to the housing 207 of the power tong 101 and includes a body 222, a female end 224, a piston 225 and a spring 228. The rotor lock 202 moves between a rotor locked position and a rotor unlocked position. The rotor lock 202 normally biases to the rotor locked position and must be actuated by fluid pressure from the tong assembly hydraulic circuit to the rotor unlocked position. In the rotor locked position shown, the female end 224 coupled to the piston 225 receives a male member 226 protruding from the rotor 300. The male member 226 aligns below the female end 224 when the rotor 300 is in the start position. The engagement between the female end 224 and the male member 226 prevents rotation and movement of the portion of the rotor having the male member 226 thereon. As shown in the top view of the power tong 101 in FIG. 4, the power tong 101 may include two rotor locks 202 on each side which may be aligned with pivot points 304 (shown in FIG. 3) where the front segments of both the housing 207 and rotor 300 open. Thus, the rotor locks 202 may engage both front opening segments of the rotor 300 to secure the segments relative to the housing 207 of the power tong 101 when the power tong 101 is in the open position. Prior to make up or break out operations, the female end 224 retracts to the rotor unlocked position by fluid pressure applied to the piston 225 in order to urge the piston 225 upward against the bias of the spring 228. Thus, the rotor lock 202 permits rotation of the rotor 300 only when in the rotor unlocked position since the female end 224 and male member 226 disengage.

FIG. 3 illustrates the rotor 300 within the power tong 101. The rotor 300 includes a segmented rotary gear 302, three active jaws 306, and support members 308 disposed between the jaws 306. The support members 308 are fixed within the inner diameter of the rotary gear 302 such that the jaws 306 and the support members 308 rotate with the rotary gear 302. Prior to rotating the rotor 300, the jaws 306 move inward in a radial direction from a release position shown to a gripping position with the jaws 306 in gripping contact with the tubular 110. A spring (not shown) biases the jaws 306 to the release position. Each of the jaws 306 include two pistons 312 hydraulically operated by a separate rotor hydraulic circuit to push a jaw pad 314 against the tubular 110 in the gripping position. Three pinions 310 driven by the three motors 111 (shown in FIG. 1) mesh with an outer circumference of the rotary gear 302 in order to rotate the rotor 300 during make up and break out operations. Since the pivot points 304 for both the housing 207 and rotor 300 are the same, there is no relative movement between the rotor 300 and housing 207 as the power tong 101 moves between the open and closed positions. Consequently, the two motors 111 on the front segments of the housing 207 do not move relative to the rotary gear 302 such that it is not necessary to actuate the two motors 111 as the power tong 101 opens and closes.

The rotary gear 302 may be tensioned prior to assembly such that the rotary gear 302 is initially deformed. Thus, when the rotary gear 302 is assembled in the power tong 101 and when the tubular 110 is gripped by the jaws 306, the deformed rotary gear reworks to obtain a circular outer circumference.

FIG. 3 illustrates the rotor 300 within the power tong 101. The rotor 300 includes a segmented rotary gear 302, three active jaws 306, and support members 308 disposed between the jaws 306. The support members 308 are fixed within the inner diameter of the rotary gear 302 such that the jaws 306 and the support members 308 rotate with the rotary gear 302. Prior to rotating the rotor 300, the jaws 306 move inward in a radial direction from a release position shown to a gripping position with the jaws 306 in gripping contact with the tubular 110. A spring 350 biases the jaws 306 to the release position. Each of the jaws 306 include two pistons 312 hydraulically operated by a separate rotor hydraulic circuit to push a jaw pad 314 against the tubular 110 in the gripping position. Three pinions 310 driven by the three motors 111 (shown in FIG. 1) mesh with an outer circumference of the rotary gear 302 in order to rotate the rotor 300 during make up and break out operations. Since the pivot points 304 for both the housing 207 and rotor 300 are the same, there is no relative movement between the rotor 300 and housing 207 as the power tong 101 moves between the open and closed positions. Consequently, the two motors 111 on the front segments of the housing 207 do not move relative to the rotary gear 302 such that it is not necessary to actuate the two motors 111 as the power tong 101 opens and closes.

The jaws 306 and support members 308 laterally support one another throughout a 360° closed circle such that corresponding torque from the rotor 300 only transmits to the tubular 110 in a tangential direction without resulting in any tilting of the jaws 306. During make up and break out operations, a side face of one jaw 306 having a close contact with a side face of an adjacent support member 308 transmits force to the adjacent support member 308 which is in close contact with another jaw 306. The closed 360° arrangement effectively locks the jaws 306 and support members 308 in place and helps the jaws 306 and support members 308 to laterally support one another, thereby inhibiting tilting of the jaws 306. Thus, load on the tubular 110 equally distributes at contact points on either side of the jaw pads 314. Adapters (not shown) for both the support members 308 and jaws 306 may be added in order to allow the power tong 101 the ability to grip tubulars having different diameters.

The jaw assembly (not shown) in the back up tong 102 may be identical to the rotor 300. However, the jaw assembly in the back up tong 102 does not rotate such that an outer ring surrounding jaws in the back up tong may not be geared with motors providing rotation.

Figure 4:
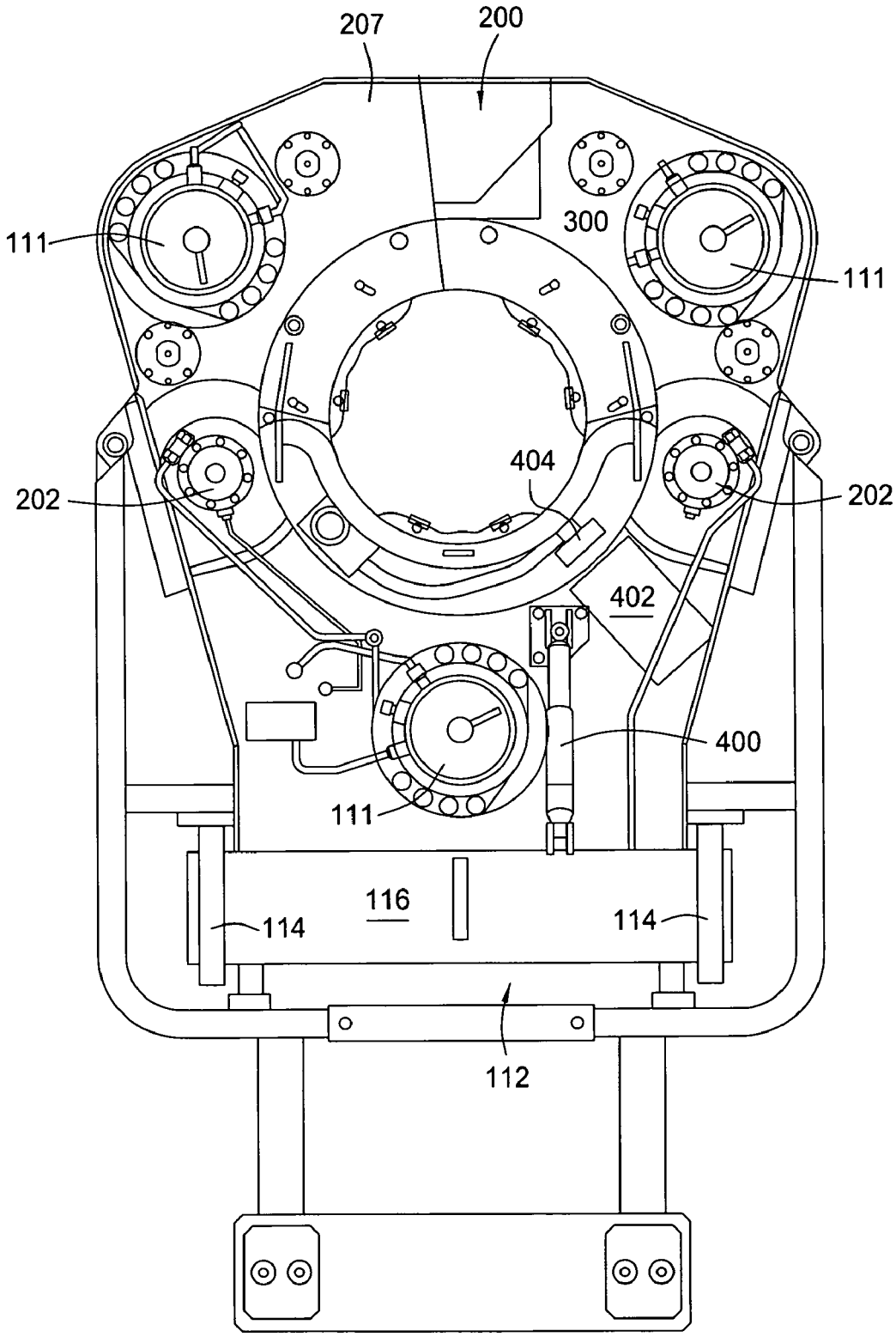
FIG. 4 is a top view of the power tong.

The top view of the power tong 101 in FIG. 4 shows a motor 402 used to operate a pump 404 that supplies hydraulic pressure to the rotor hydraulic circuit that actuates the jaws 306. The motor 402 may be actuated by the tong assembly hydraulic circuit. The motor 402 mounts on the housing 207 while the pump mounts on the rotor 300. Therefore, the motor 402 must disengage from the pump 404 after the pump 404 actuates the jaws 306 in order to allow the pump 404 to rotate with the rotor 300 during make up and break out operations.

Figure 5:
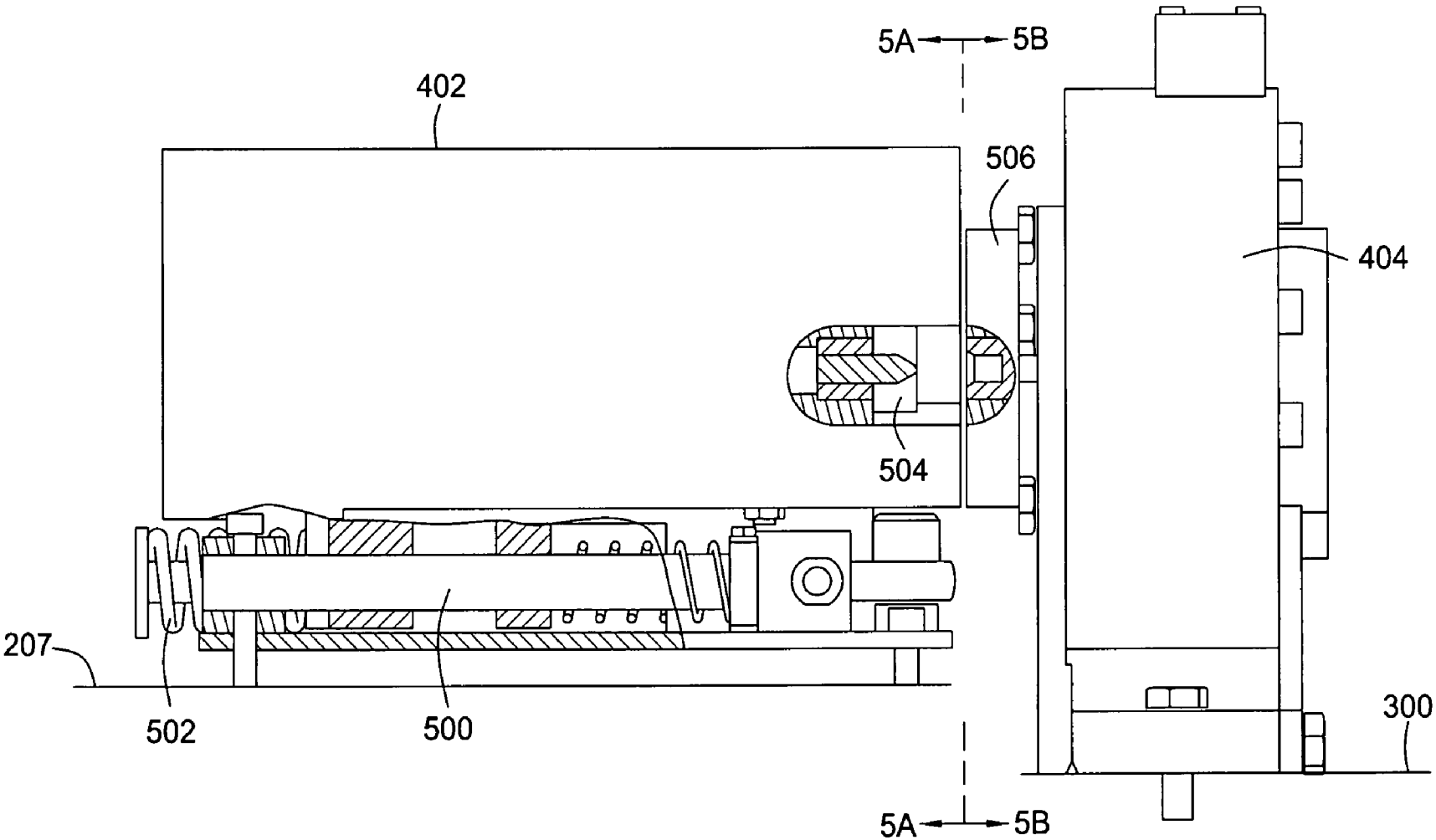
FIG. 5 is a side view of a motor disposed on a housing of the power tong that operates a pump on the rotor in order to actuate the jaws.
Figure 5B:
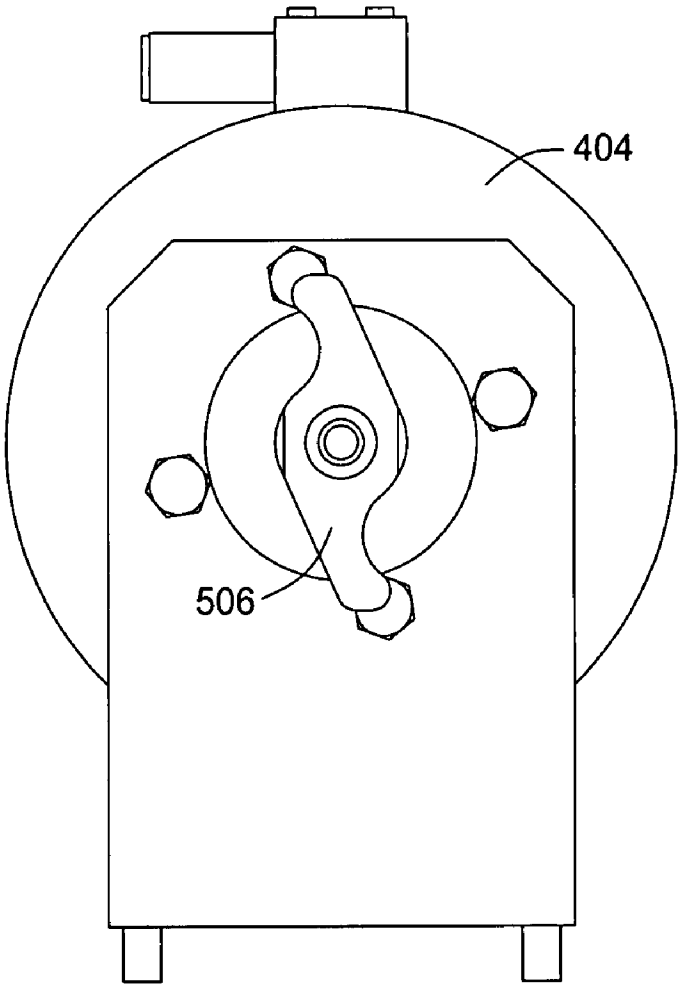
FIG. 5B is a view of an end of the pump along line 5B-5B in FIG. 5.
Figure 5A:
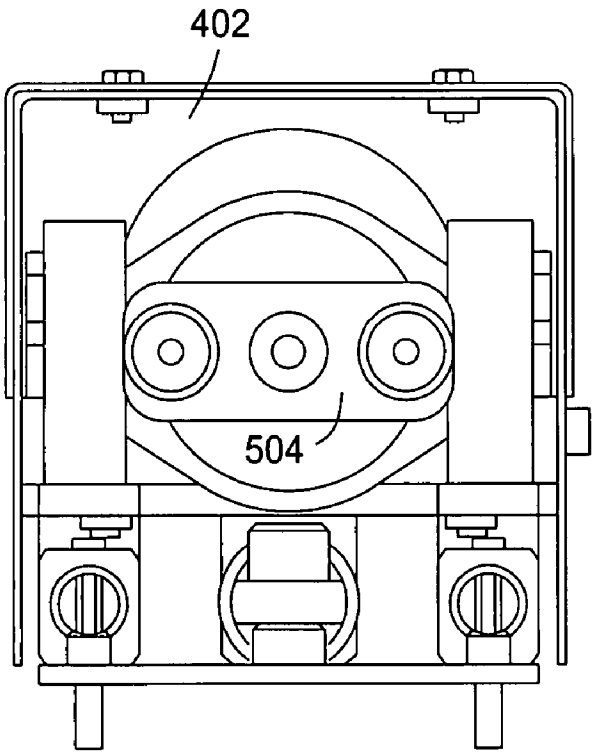
FIG. 5A is a view of an end of the motor along line 5A-5A in FIG. 5.

FIGS. 5, 5A and 5B illustrate a releasable coupling arrangement between the motor 402 secured to the housing 207 and the pump 404 secured to the rotor 300. The motor 402 slides along a guide shaft 500 between an engaged position toward the pump 404 and a disengaged position away from the pump 404. As shown, a spring 502 biases the motor 402 to the disengaged position. Hydraulic fluid supplied from the tong assembly hydraulic circuit moves the motor 402 against the bias of the spring 502 toward the pump 404. As the motor 402 moves toward the pump 404, a coupling such as a claw 504 of the motor 402 engages a mating coupling such as an elongated S-shaped bar 506 of the pump 404. The claw 504 and the S-shaped bar 506 provide a wide angle for possible engagement with each other. However, the claw 504 and S-shaped bar 506 may interferingly hit one another without engaging. To simplify the next engagement of the claw 504 with the S-shaped bar 506 due to a missed engagement or for subsequent operations of the pump 404, the motor 402 rotates the claw 504 a small amount as the motor 402 slides on the guide shaft 500 back to the disengaged position. As shown in further detail in FIG. 7, pressurized fluid used to fill a piston chamber in order to move the motor 402 on the guide shaft 500 toward the pump 404 flows to the motor 402 to turn the claw 504. Since the volume of the piston chamber remains the same, the claw 504 of the motor 402 rotates a fixed amount with every movement of the motor 402 between the engaged and disengaged positions.

Figure 6:
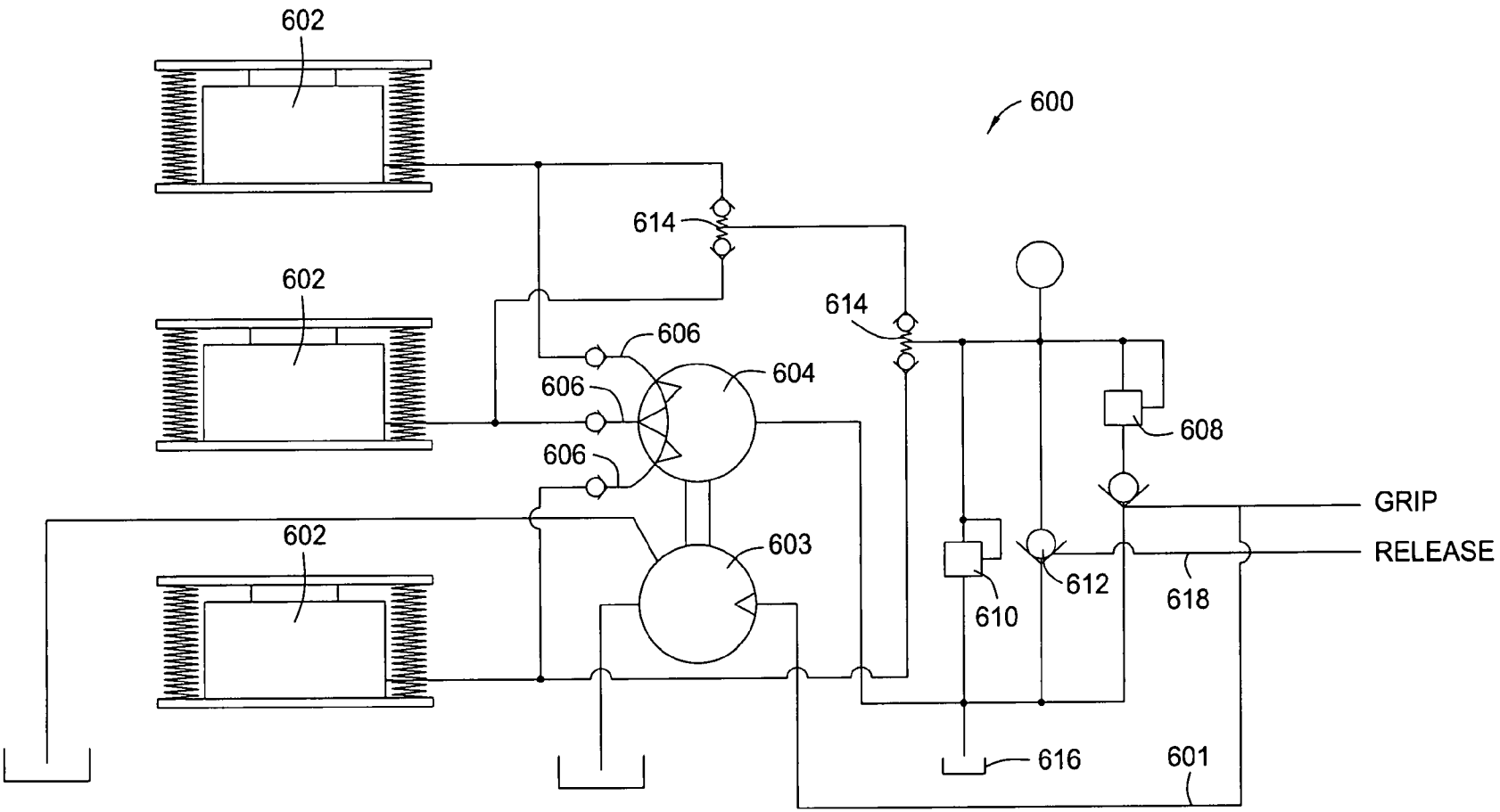
FIG. 6 is a schematic of a back up tong hydraulic circuit used to actuate jaws of the back up tong.

FIG. 6 illustrates a schematic of a back up tong hydraulic circuit 600 used to actuate jaws 602 of the back up tong 102 in order to grip the lower tubular 108 as shown in FIG. 1. A grip line 601 from the tong assembly hydraulic circuit selectively supplies fluid pressure to a back up tong motor 603 that operates a single back up tong pump 604. The jaws 602 of the back up tong 102 connect to the back up tong pump 604 which supplies an equal volume and pressure of fluid to each of the jaws 602 through three equal flow outlets 606. To prevent a stop of the motor/pump 603, 604 with only one of the jaws 602 in gripping contact, the hydraulic circuit 600 provides a cascade circuit with flow from all three jaws 602 passing to a single common adjustable pressure limiter 608, a single common preset safety valve 610 and a single common release check valve 612. Due to the arrangement of the two check valves 614, the pump 604 continues to supply pressurized fluid even if one of the jaws 602 grips prior to the other jaws 602. Pressurized fluid supplied to the jaw gripping prematurely flows to the tank 616 while the other jaws continue to receive fluid pressure for proper actuation. Therefore, there is no volumetric influence of one of the jaws 602 with respect to the other jaws. After completing the make up or break out operation, a hydraulic signal through a release line 618 of the tong assembly hydraulic circuit opens the release check valve 612 and permits fluid pressure acting on the jaws 602 to dump to the tank 616. The back up tong hydraulic circuit 600 with the pump 604 may supply high pressures such as greater than 6000 pounds per square inch or 500 bar.

Figure 7:
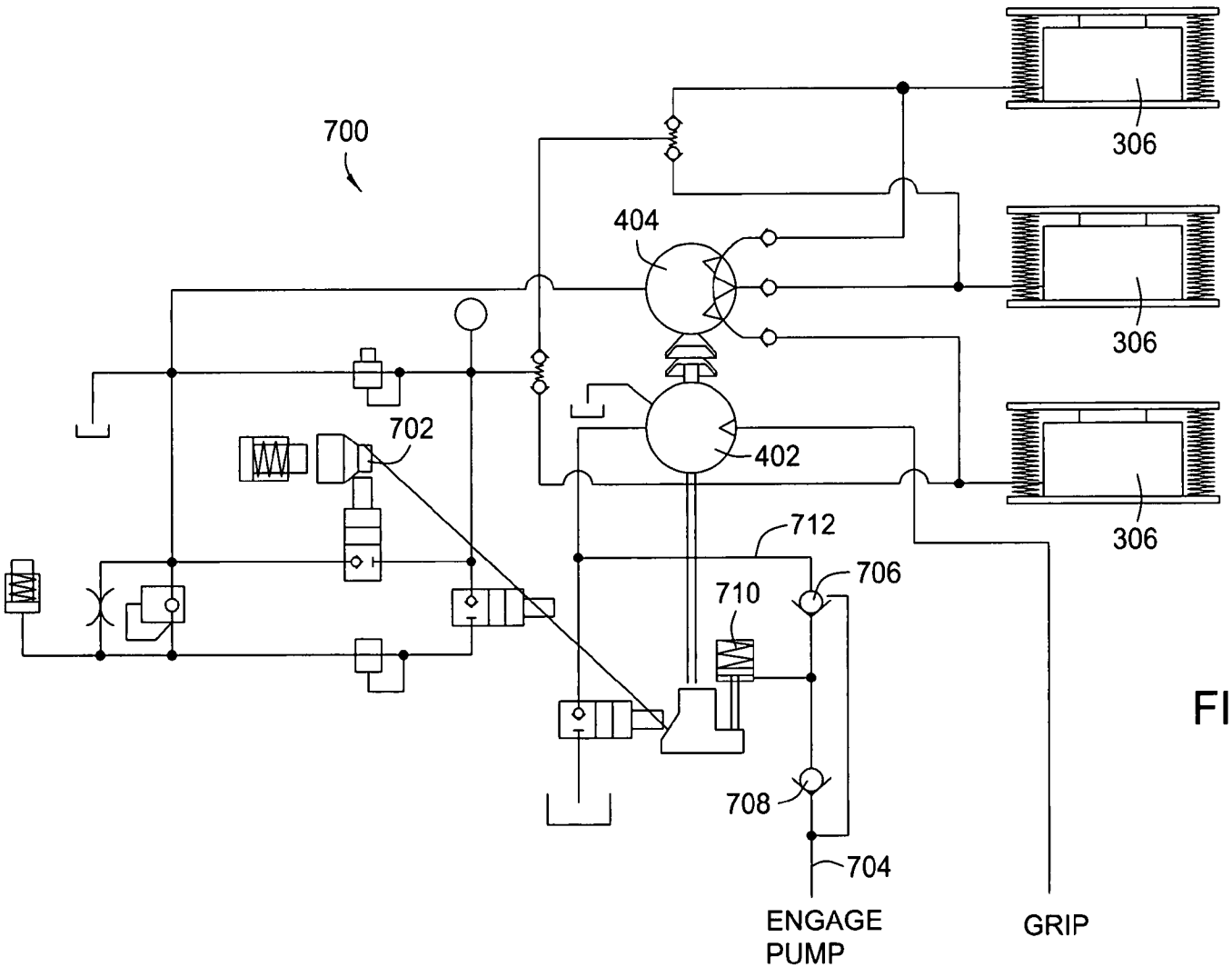
FIG. 7 is a schematic illustrating engagement of the motor and the pump used in a rotor hydraulic circuit that actuates the jaws of the power tong.

FIG. 7 shows a schematic illustrating engagement of the motor 402 and the pump 404 used in a rotor hydraulic circuit 700 that actuates the jaws 306 of the power tong 101. The jaws 306 actuate through a similar manner as described above with respect to the back up tong hydraulic circuit 600 in FIG. 6. However, a release valve 702 is opened upon completing the make up or break out operation. The schematic in FIG. 7 also illustrates the motor 402 that is moveable between the engaged and disengaged positions. To move the motor 402 from the disengaged position to the engaged position, fluid selectively supplied from the tong assembly hydraulic circuit to an engage pump line 704 passes through check valve 708 and enters piston chamber 710 in order to move the motor 402 toward the pump 404. The fluid pressure in the engage pump line 704 closes check valve 706. However, release of fluid pressure from the engage pump line 704 permits pressurized fluid from the piston chamber 710 to pass through check valve 706 into a motor drive line 712 in order to rotate a claw 504 of the motor 402 as described above when the motor returns from the engaged position to the disengaged position.

Figure 8:
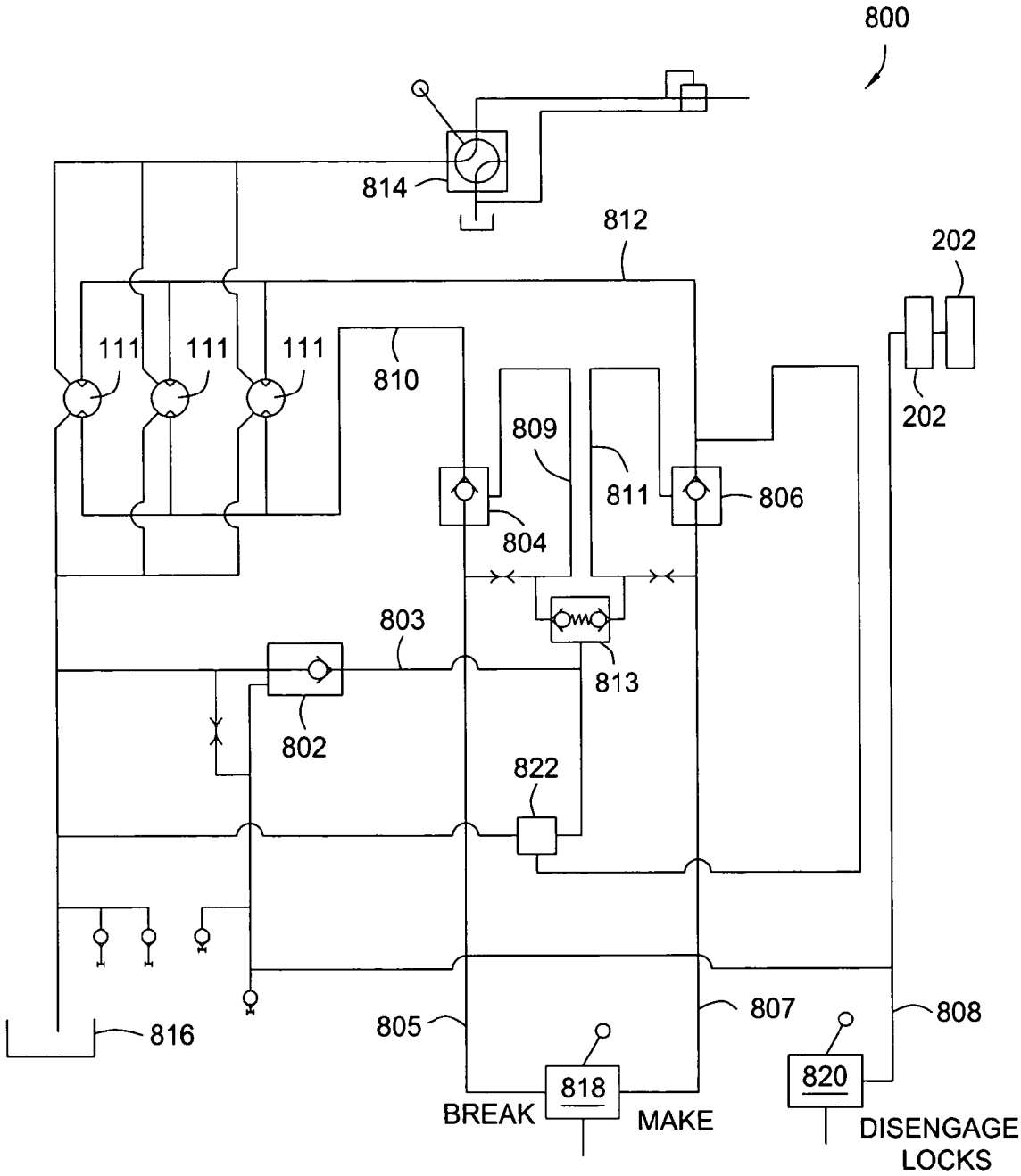
FIG. 8 is a schematic of a portion of a tong assembly hydraulic circuit that provides a safety interlock between the rotor lock and fluid supplied to operate drive motors.

FIG. 8 illustrates an interlock portion 800 of the tong assembly hydraulic circuit that provides a safety interlock that includes the rotor locks 202 and a motor lockout that selectively blocks fluid supplied to operate the drive motors 111. The interlock portion 800 includes a normally open pilot valve 802 having an input from a dump line 803 and an output to a tank 816, a first check valve 804 having an input from a break out supply line 805 and an output to a reverse drive line 810, and a second check valve 806 having an input from a make up supply line 807 and an output to a forward drive line 812. An automated or manually operated drive valve 818 selectively supplies fluid pressure to one of the supply lines 805, 807 at the appropriate time. Fluid supplied through the reverse drive line 810 operates the motors 111 for break out, and fluid supplied through the forward drive line 812 operates the motors 111 in an opposite direction for make up. Thus, the drive motors 111 only operate when the check valves 804, 806 can open to permit fluid flow between one of the supply lines 805, 807 and a corresponding one of the drive lines 810, 812. A first pilot port line 809 connects a pilot port of the first check valve 804 with the break out line 805, and a second pilot port line 811 connects a pilot port of the second check valve 804 with the make up line 807. The check valves 804, 806 only open when the pilot port lines 809, 811 supply fluid pressure to the pilot ports. However, the pilot port lines 809, 811 do not supply an opening pressure to the pilot ports of the check valves 804, 806 when the pilot valve 802 is open since the pilot port lines 809, 811 connect through check valve 813 to the dump line 803 that passes fluid to the tank 816 when the pilot valve 802 is open.

As described above, the rotor locks 202 physically block rotation of the rotor 300 until a fluid pressure is applied to the rotor locks 202 in order to place the rotor locks 202 in the rotor unlocked position. Thus, the fluid pressure for placing the rotor locks 202 in the rotor unlocked position is supplied from the tong assembly hydraulic circuit through a disengage locks line 808 that may be controlled independently from the supply lines 805, 807 by a lock valve 820. A portion of the fluid from the disengage locks line 808 is supplied to a pilot port of the pilot valve 802 in order to close the pilot valve 802 only when both the rotor locks 202 are in the rotor unlocked position. Once the pilot valve 802 closes, fluid pressure from either of the supply lines 805, 807 can pressurize a corresponding one of the pilot port lines 809, 811 that are no longer open to the tank 816, thereby permitting opening of a corresponding one of the check valves 804, 806. Thus, opening the drive valve 818 supplies fluid selectively to one of the supply lines 805, 807, which are blocked from operating the drive motors 111 until actuation of the rotor locks 202 unlocks the interlock that provides the motor lockout. Once both the rotor locks 202 actuate and the drive valve 818 is opened to permit fluid flow to the appropriate supply line 805, 807, a pressurized fluid is simultaneously supplied to all of the motors 111 through a corresponding one of the drive lines 810, 812 during make up or break out. Further, each motor 111 produces the same torque and any mechanical parts for "locking" such torque are not necessary as all the motors 111 simultaneously stop hydraulically due to the check valves 804, 806. A gear change 814 may be used to adjust the suction volume of the motors 111 in order to adjust the speed of the motors 111. Additionally, a solenoid valve (not shown) can be activated such that the drive motors 111 are also immediately stopped, and a pressure limiter 822 may protect the interlock portion 800.

In alternative embodiments, the pilot valve 802 is closed by a signal other than the hydraulic signal from the disengage locks line 808. For example, the pilot valve 802 may be controlled to close by an electric signal supplied thereto or may be manually closed. Further, the hydraulic circuit shown for the interlock portion 800 may be used in applications and methods other than tong assembly 100 where there is a desire to block actuation of motors prior to receiving a signal from an interlock.

The tong assembly 100 described herein may be used in a method of making up a tubular connection between a first tubular 110 and a second tubular 108. For clarity, the method is described using the reference characters of the figures described herein when possible. The method includes opening a power tong 101 and back up tong 102 of the tong assembly 100 and positioning the tubulars 108, 110 therein. The method further includes, closing the tongs 101, 102 around the tubulars 108, 110, locking gate locks 200, 201 to maintain the tongs 101, 102 and a rotor 300 in the closed position, actuating jaws 306 of the tongs 101, 102 such that the power tong 101 grips the first tubular 110 and the back up tong 102 grips the second tubular 108, unlocking a rotor lock 202 to permit rotation of the rotor 300, and unlocking an interlock including a rotor motor lockout. Additional, the method includes rotating the rotor 300 by distributing a drive force on the rotor 300 such as by simultaneous rotation of at least three motors 111, wherein rotating the rotor 300 rotates the first tubular 110 relative to the second tubular 108 and forms the connection. The method may be used with connections in tubulars having diameters greater than fifteen inches such as risers.

While the foregoing is directed to embodiments of the present invention, other and further embodiments of the invention may be devised without departing from the basic scope thereof, and the scope thereof is determined by the claims that follow.

The invention claimed is:

1. An apparatus for handling a first tubular and a second tubular during make up and break out operations, comprising:

a tong having jaws radially arranged within a rotatable member and moveable toward a center for gripping the first tubular, wherein each jaw is actuated by a substantially equal supply of fluid independently controlled by a common pressure limiter; and a back up member for gripping the second tubular and preventing rotation thereof.

2. The apparatus of claim 1, further comprising an interlock, the interlock selectively preventing operation of the rotatable member.

3. The apparatus of claim 1, further comprising a support member rigidly disposed in between the jaws to provide lateral support thereto when the jaws grip the first tubular.

4. The apparatus of claim 3, further comprising the support member is disposed in an alternating fashion between the jaws.

5. The apparatus of claim 1, further comprising at least three drive motors arranged around the rotatable member for simultaneously rotating the rotatable member within the tong.

6. The apparatus of claim 1, wherein the first and second tubulars are part of a riser string.

7. The apparatus of claim 1, wherein the first and second tubulars are at least fifteen inches in diameter.

8. The apparatus of claim 1, further comprising a gate lock for securing a gate in a housing of the tong and a gate of the rotatable member in a closed position.

9. The apparatus of claim 1, further comprising a releasable coupling arrangement having an actuation piston for moving a motor into engagement with a pump on the rotatable member, wherein a fluid return of the actuation piston is in fluid communication with the motor for providing a limited motor operation.

10. An apparatus for handling a tubular, comprising:

a plurality of jaws for gripping a tubular, wherein the plurality of jaws are biased toward an ungripped positon, wherein each jaw is actuated by a substantially equal supply of fluid controlled by a pressure limiter;

a rotor for rotating the jaw and the tubular therein, the rotor having a substantially circular member with a geared surface; and at least three motors coupled to pinions meshed with the geared surface for providing rotation to the rotor.

11. The apparatus of claim 10, wherein the pinions are spaced around the circular member at substantially 120° intervals.

12. An apparatus for gripping a tubular, comprising:

at least two jaws having a gripping surface movable radially inward toward the tubular, wherein each jaw is actuated by an equal supply of fluid and is independently pressure controlled by a common pressure limiter in fluid communication with all the jaws through a cascading circuit formed by check valves; and at least one support member disposed between the at least two jaws for providing lateral support thereto, wherein each jaw has a surface in close contact with an adjacent surface of the support member.

13. The apparatus of claim 12, further comprising a plurality of support members.

14. The apparatus of claim 13, wherein the jaws and the plurality of support members are in close contact with each other in a closed circular arrangement.

15. The apparatus of claim 12, wherein the apparatus comprises three jaws spaced at substantially 120° intervals.

16. The apparatus of claim 1, wherein the suspension is a member coupled between the arms, for absorbing torsion from the reaction force in each arm.

17. The apparatus of claim 16, wherein the member is a horizontal bar.

18. The apparatus of claim 17, a compression link attachable between the back up tong and the torque bar assembly.

19. The apparatus of claim 10, wherein the rotor is a gated rotor.

20. The apparatus of claim 10, further comprising one or more actuators for actuating the jaws independently of the rotor.

21. The apparatus of claim 20, wherein the actuator comprises a fluid pressure circuit.

22. The apparatus of claim 1, wherein the common pressure limiter is in fluid communication with all the jaws through a cascading circuit.

23. The apparatus of claim 22, wherein the cascading circuit is formed by check valves.

24. A method of making up a tubular connection between a first tubular and a second tubular, comprising:

providing a tong having a plurality of jaws radially arranged within a rotatable member;

supplying fluid at substantially the same pressure to each of the jaws to move the jaws toward a center to cause the jaws to grip the first tubular such that, in the event of one of the jaws gripping the first tubular before another of the jaws, the supply of pressurized fluid to said other jaw continues until said other jaws grips the first tubular; and gripping the second tubular by a back up member to prevent rotation of the second tubular.

* * * * *